US007415945B2

(12) United States Patent
Tuttle

(10) Patent No.: US 7,415,945 B2
(45) Date of Patent: Aug. 26, 2008

(54) FLUID ACTUATED FAN CONTROL METHOD FOR A VEHICLE

(75) Inventor: Michael D. Tuttle, Lake Orion, MI (US)

(73) Assignee: BorgWarner Inc.

( * ) Notice: Subject to any disclaimer, the term of this patent is extended or adjusted under 35 U.S.C. 154(b) by 46 days.

(21) Appl. No.: 10/908,481

(22) Filed: May 13, 2005

(65) Prior Publication Data

US 2006/0254540 A1 Nov. 16, 2006

(51) Int. Cl.
*F01P 7/02* (2006.01)

(52) U.S. Cl. ..... 123/41.11; 123/41.49

(58) Field of Classification Search ..... 123/41.49, 123/41.11, 41.12
See application file for complete search history.

(56) References Cited

U.S. PATENT DOCUMENTS 4,426,960 A * 1/1984 Hart ..... 123/41.49
4,441,462 A * 4/1984 Budinski ..... 123/41.11
4,694,784 A * 9/1987 Hirano et al. ..... 123/41.12
5,747,883 A * 5/1998 Hammer et al. ..... 290/1 B
6,079,385 A * 6/2000 Wicke ..... 123/198 R
6,453,853 B1 * 9/2002 Hawkins et al. ..... 123/41.12
6,463,891 B2 * 10/2002 Algrain et al. ..... 123/41.12
2002/0066422 A1 * 6/2002 Hawkins et al. ..... 123/41.12
2005/0284423 A1 * 12/2005 Fujie ..... 123/41.12

* cited by examiner

*Primary Examiner*—Noah Kamen
(74) *Attorney, Agent, or Firm*—John A. Artz

(57) ABSTRACT

A method of controlling a fluid actuated fan drive system (12) for an engine (14) includes determining an engine speed. The speed of a fluid actuated engine-cooling fan (16) is limited when the engine speed is greater than or equal to an engine over-speed level. The fluid controlled fan drive system (12) includes a sensor (31) that generates an engine speed signal. The system (12) also includes the fluid actuated engine-cooling fan (16) and an engagement circuit (36) that is coupled thereto. A controller (28) is coupled to the sensor (31) and the engagement circuit (36) and limits operating speed of the engine-cooling fan (16) to less than a predetermined level when the engine speed signal is indicative of an engine over-speed condition.

20 Claims, 5 Drawing Sheets

FLUID ACTUATED FAN CONTROL METHOD FOR A VEHICLE

TECHNICAL FIELD

The invention relates generally to fan drive systems and more specifically to fluid actuated fan drive systems and controlling methods thereof.

BACKGROUND ART

The present invention relates to fluid coupling devices, such as viscous drives and hydraulic fluid drives. The fluid coupling devices are generally of the type that include both a fluid operating chamber and a fluid reservoir chamber, and in addition valving to control the quantity of fluid in the operating chamber.

A fluid coupling device may be referred to as a viscous drive, a hydraulic fluid drive, or a combination thereof. A viscous drive generally refers to a fluid coupling device that has clutch members that are engaged due to the amount of friction therebetween. A hydraulic fluid drive generally refers to a fluid coupling device that is engaged via hydraulic fluid and/or pressure thereof.

Viscous and hydraulic drives have become popular due to their ability to cycle repeat, engage at higher engine speeds, and have varying degrees of engagement. Hydraulic fluid drives also allow for full engagement and thus increased operating speeds. Viscous and hydraulic drives may be operated using an open loop fan drive control methodology. Open loop fan drive control allows for the speed of a fan drive to be adjusted continuously to any fan speed in response to changing situations. Open loop control is particularly advantageous in viscous and hydraulic drive systems, which can have infinite variability.

The use of such a methodology, however, can cause an over-speed condition to arise in certain situations. For example, when a vehicle is traveling down a steep hill the engine speed of the vehicle can increase and thus cause the fan speed to increase, due to fan load on and coupling of the fan to the engine. The fan in essence is performing as a brake on the engine. Energy is transferred from the drivetrain and engine to the fan. The increase in engine speed can exceed beyond a normal operating speed, and be such to cause the fan to spin at high speeds not originally designed. In other words, the fan can "race" or spin at such a speed as to cause degradation to fan drive system internal components. This condition especially arises when the fan drive system is fully engaged and there is negligible slip between the engine and the fan.

Thus, there exists a need for an improved fan drive system that prevents such an over-speed condition from arising.

SUMMARY OF THE INVENTION

The present invention addresses the issues described above and provides a method of controlling a fluid actuated fan drive system for an engine includes determining an engine speed. The speed of a fluid actuated engine-cooling fan is limited when the engine speed is greater than or equal to an engine over-speed level.

A fluid controlled fan drive system for an engine is also provided and includes a sensor that generates an engine speed signal. The system also includes a fluid actuated engine-cooling fan and an engagement circuit that is coupled thereto. A controller is coupled to the sensor and the engagement circuit and limits operating speed of the engine-cooling fan to less than a predetermined level when the engine speed signal is indicative of an engine over-speed condition.

One of several advantages of the present invention is that it limits speed of and/or prevents the rotation of a fluid actuated engine-cooling fan when an engine over-speed condition arises. The rotation speed limiting of the fluid actuated fan prevents degradation to internal and external fan drive system components. This increases the operating life of the fan drive system.

Another advantage of the present invention is that it provides versatility in control in that multiple style control circuits may be utilized depending upon the application.

The present invention itself, together with further objects and attendant advantages, will be best understood by reference to the following detailed description, taken in conjunction with the accompanying drawing.

BRIEF DESCRIPTION OF THE DRAWINGS

For a more complete understanding of this invention reference should now be had to the embodiments illustrated in greater detail in the accompanying figures and described below by way of examples of the invention wherein.

DETAILED DESCRIPTION

Figure 1:
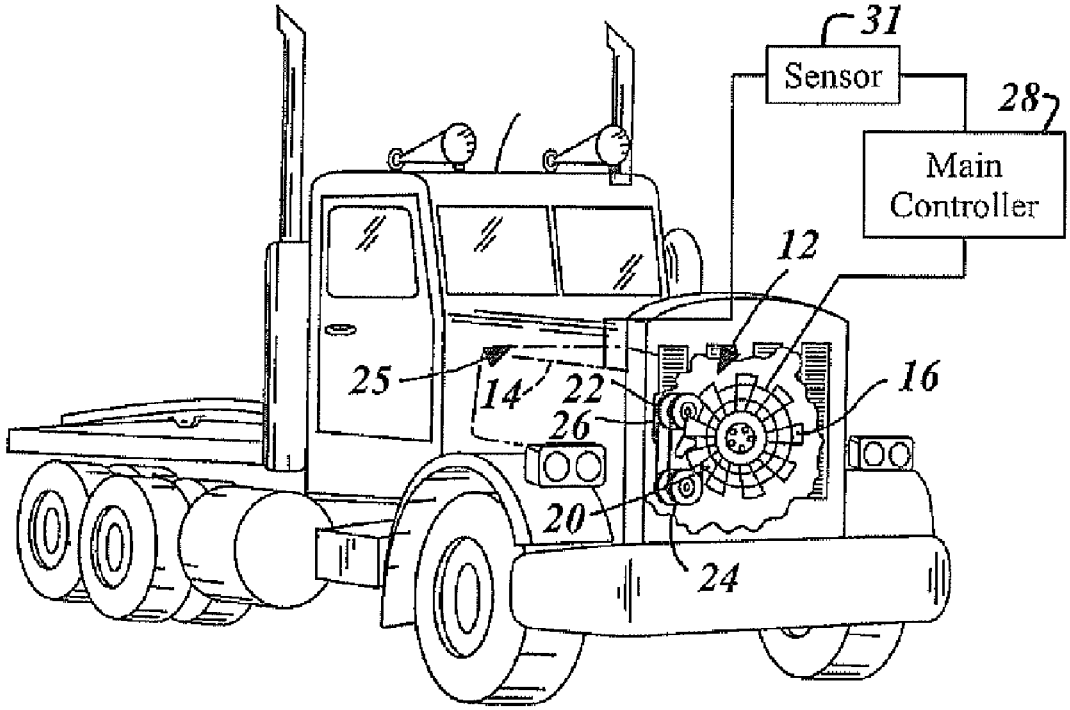
FIG. 1 is a perspective view of a vehicle utilizing a fluid controlled fan drive system in accordance with an embodiment of the present invention.

In the following figures the same reference numerals will be used to refer to the same components. While the present invention is described with respect to a method and system for a fluid controlled fan drive system, the present invention may be adapted and applied to various systems including: fan drive systems, viscous fan drive systems, hydraulic fluid actuated fan drive systems, or other vehicle and cooling systems.

Although the present invention may be used advantageously in various configurations and applications, it is especially advantageous in a coupling device of the type used to drive a radiator cooling fan of an internal combustion engine for a over the road truck, such as a class 8 truck, and will be described in connection therewith.

In the following description, various operating parameters and components are described for one constructed embodiment. These specific parameters and components are included as examples and are not meant to be limiting.

Also, in the following description various fan drive components and assemblies are described as an illustrative example. The fan drive components and assemblies may be modified depending upon the application.

Referring now to FIG. 1, a perspective view of a vehicle 10 utilizing a fluid controlled fan drive system 12 in accordance with an embodiment of the present invention is shown. The system 12 uses rotational energy from a liquid cooled engine 14 at an increased ratio to turn a radiator cooling fan 16 to provide airflow through a radiator 18. The system 12 includes a housing assembly 20 fixed to a pulley 22, which is coupled to and rotates relative to a crankshaft (not shown) of the engine 14, via a pair of belts 24, within an engine compartment 25. Of course, the present invention may be relatively operative in relation to various components and via any number of belts or other coupling devices, such as a timing chain. The housing assembly 20 is mounted on the engine 14 via a mounting bracket 26. The housing assembly 20, which is part of a fan drive circuit 27 (best seen in FIGS. 2A and 2B, hydraulically engages the fan 16 during desired cooling intervals to reduce temperature of the engine 14 or to perform other tasks, some of which stated below.

A controller, such as a main controller 28 or a fluid controller 29 (shown in FIG. 2A), is coupled to the fan drive circuit 27 and limits the speed of the fan 16 in the event of an engine over-speed condition, which is described in greater detail below. An "over-speed condition" refers to a condition when the engine is operating at a speed that is greater than original designed to operate for a given situation. This can occur, as an example, when the speed of the engine is greater than it would otherwise normally be when operating under it's own power source, such as a fuel source. For example, an engine may have an average operating speed of approximately between 1500-2500 rpm and/or a designed peak operating speed of 4500 rpm. During an over-speed condition the engine speed may be greater than 2500 rpm and/or 4500 rpm when the fan 16 is being used as a brake or when energy other than from the vehicle's power source is being induced causing increased fan speed. Operation of the engine at the increased speeds for an extended period of time can reduce the operating life of or cause degradation to engine components and related systems. The engine speeds provided above are for example purposes and may vary considerably depending upon the engine, fan drive, and vehicle.

An engine speed sensor 31 is coupled to and is used to detect the speed of the engine 14. The controller 28 is coupled to the sensor 31. The sensor 31 may alternatively or also be coupled to other drivetrain components or systems for engine speed detection. The sensor 31 may be of various types and styles known in the art. The sensor 31 may be a camshaft rotational speed sensor, a crankshaft rotational speed sensor, an optical sensor, a rotational sensor, an ultrasonic sensor, an infrared sensor, or some other speed sensor known in the art.

The fan 16 may be attached to the engine 14 or to the housing assembly 20 by any suitable means, such as is generally well known in the art. It should be understood that the use of the present invention is not limited to any particular configuration of the system 12, to any fan mounting arrangement, or to any particular application for the system 12. The present invention may be applied to viscous drive systems, hydraulic fluid drive systems, or a combination thereof, as is described below with respect to the embodiments of FIGS. 2A and 2B.

Figure 2A:
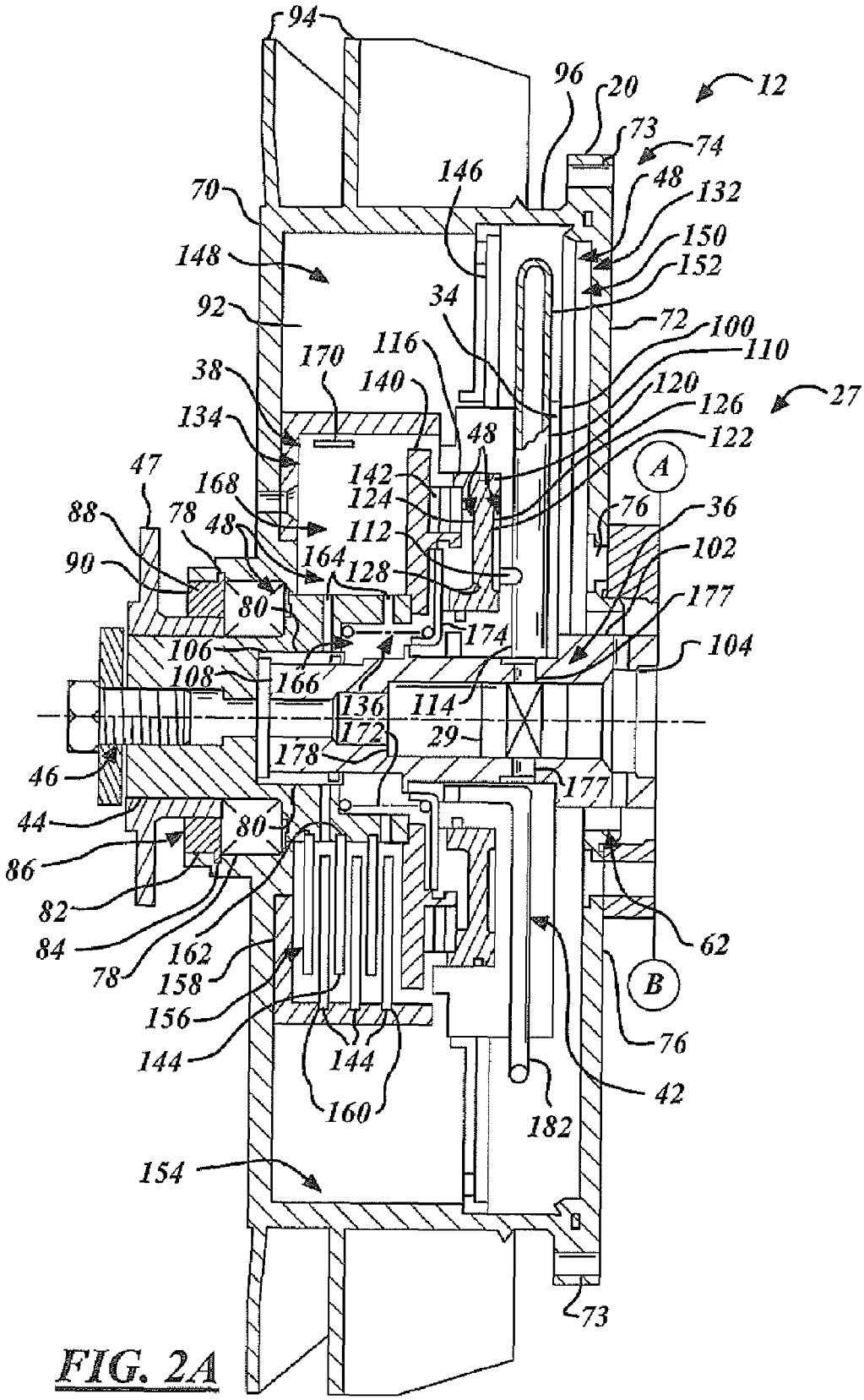
FIG. 2A is a first portion of a cross-sectional view of the fluid controlled fan drive system in accordance with an embodiment of the present invention.
Figure 2B:
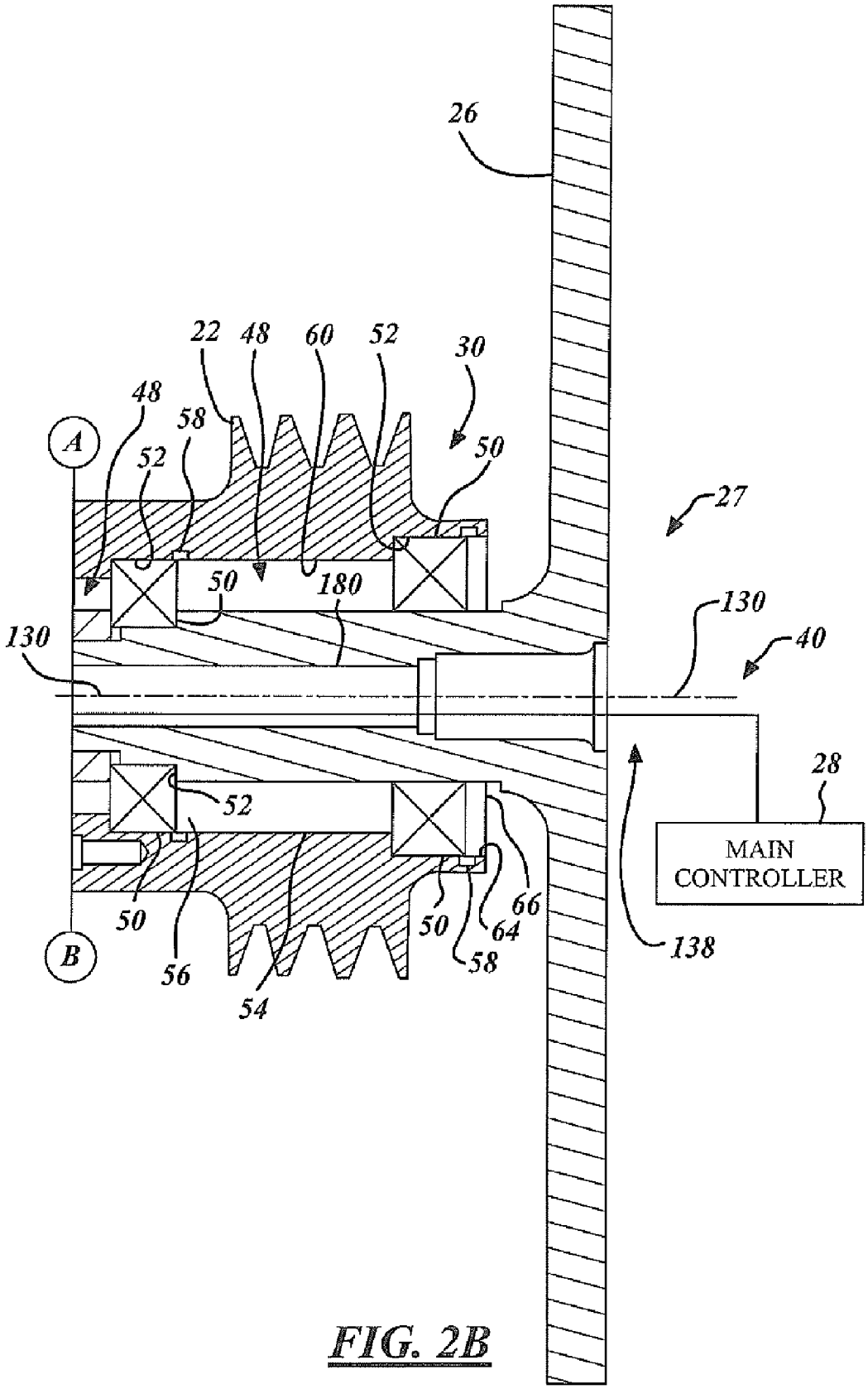
FIG. 2B is a second portion of a cross-sectional view of the fluid controlled fan drive system in accordance with an embodiment of the present invention.

Referring now to FIGS. 2A and 2B, a first portion and a second portion of a cross-sectional view of the system 12 in accordance with an embodiment of the present invention are shown. The system 12 includes the drive circuit 27, which includes an input circuit 30, the housing assembly 20, a piston assembly 34, an engaging circuit 36 having a mechanical portion 38 and an electrical portion 40, and a variable cooling and lubrication circuit 42. The input circuit 30 provides rotational energy to the housing assembly 20. The engaging circuit 36 engages the housing assembly 20 to a fan shaft 44, via the piston assembly 34, to rotate the fan 16. The fan 16 may be coupled to the fan shaft 44 via splines 46, which is threaded into the fan shaft 44, or by other techniques known in the art, such as being coupled to the fan hub 47. The fan shaft 44 may be a single unit, as shown, or may be split into a fan shaft portion and a clutch shaft portion. The variable cooling circuit 42 provides distribution of hydraulic fluid 48 throughout and in turn cooling and lubricating components within the housing assembly 20. The hydraulic fluid may be an oil-based fluid or similar fluid known in the art.

The input circuit 30 includes the pulley 22 that rotates about the mounting bracket 26 on a set of pulley bearings 50. The pulley bearings 50 are held between pulley bearing notches 52, in a stepped inner channel 54 of the pulley 22, and pulley bearing retaining rings 56, that expand into pulley ring slots 58 in an interior wall 60 of the pulley 22. The pulley 22 may be of various type and style, as known in the art. The inner channel 54 corresponds with a first center opening 62 in the housing assembly 20. The hydraulic fluid 48 flows through the center opening 62 into the inner channel 54 and cools and lubricates the bearings 50. A first seal 64 resides in the inner channel 54 on an engine side 66 of the pulley 22 for retaining the hydraulic fluid 48 within the housing assembly 20.

The housing assembly 20 includes a die cast body member 70, and a die cast cover member 72, that may be secured together by bolts (not shown) through channels 73 of the outer periphery 74 of the die cast member 70 and cover member 72. The die cast member 70 and the cover member 72 may be secured together using other methods known in the art. It should be understood that the present invention is not limited to use with a cast cover member, but may also be used with other members such as a stamped cover member. The housing assembly 20 is fastened to the pulley 22, via fasteners (not shown) extending through the cover member 20 into the pulley 22 in designated fastener holes 76. The housing assembly 20 rotates in direct relation with the pulley 22 and rides on housing bearings 78 that exists between the housing assembly 20 and the fan shaft 44. The housing bearing 78 is held within the housing assembly 20 between a corresponding housing bearing notch 80 in the body member 70 and a housing bearing retainer ring 82 that expands into a housing ring slot 84. A second center opening 86 exists in the body member 70 to allow the hydraulic fluid 48 to also circulate, cool, and lubricate the housing bearings 78. A second seal 88 resides on a fan side 90 of the housing assembly 20 for retaining the hydraulic fluid 48 within the housing assembly 20.

The body member 70 has a fluid reservoir 92 containing the hydraulic fluid 48. Cooling fins 94 are coupled to an exterior side 96 of the body member 70 and perform as a heat exchanger by removing heat from the hydraulic fluid 48 and releasing it within the engine compartment 25. The cover member 72 may be fastened to the body member 70 using various methods known in the art. Note, although the fan 16 is shown as being attached to the body member 70 it may be coupled to the cover member 72.

The piston assembly 34 includes a piston housing 100 rigidly coupled to a distribution block 102, which is rigidly coupled to the bracket 26 on a first end 104. The distribution block 102 is coupled to a fan shaft bearing 106 on a second end 108, which allows the fan shaft 44 to rotate about the second end 108. The piston housing 100 has a main pitot tube channel 110, that has a piston branch 112 and a controller branch 114, for flow of the hydraulic fluid 48 to a translating piston 116 and to the hydraulic fluid controller 29. The piston 116 is coupled within a toroidally shaped channel 120 of the housing 100 and has a pressure side 122 and a drive side 124, with a respective pressure pocket 126 and drive pocket 128. The piston translates along a center axis 130 to engage the housing assembly 20 to the fan shaft 44, via hydraulic fluid pressure from the piston branch 112.

The engaging circuit 36 includes a hydraulic fluid supply circuit 132, a clutch plate assembly 134, a return assembly 136, and a control circuit 138. The hydraulic circuit 132 applies pressure on the piston 116 to drive an end plate 140, riding on a separation bearing 142 between the endplate 140 and the piston 116, against clutch plates 144 within the clutch plate assembly 134 and engages the fan 16. The control circuit 138 controls operation of the piston 116 and engagement of the fan 16. Of course, any number of clutch plates may be used. Also, although a series of clutch plates are utilized to engage the fan 16 other engagement techniques known in the art may be utilized.

The hydraulic circuit 132 may include a baffle 146 separating a relatively hot cavity side 148 from a relatively cool cavity side 150 of the fluid reservoir 92 and a pressure pitot tube 152. The pressure tube 152 although shown as being tubular in shape may be of various sizes and shapes. The pressure tube 152 receives hydraulic fluid 48 from within the cool side 150, providing cooling to the engaging circuit 36, due to flow of the fluid 48 from rotation of the housing assembly 20, carrying the fluid 48 in a radial pattern around an inner periphery 154 of the housing assembly 20. The pressure tube 152 is rigidly coupled within the main channel 110 and is therefore stationary. As fluid 48 is circulating about the inner periphery 154, a portion of the fluid 48 enters the pressure tube 152 and applies pressure on the pressure side 122 of the piston 116.

Since the fan 16 has a variable drive speed due to proportional pressure within the pressure tube 152, at low engine speeds, such as during an idle condition, the fan 16 is rotating at a low speed. When the engine 14 is power OFF, there is minimum torque existing in the fan 16, which may be absorbed by the belts 24, unlike that of prior art systems.

The clutch plate assembly 134 includes a clutch pack 156 within a drum housing 158. The clutch pack 156 includes the multiple clutch plates 144 separated into a first series 160 coupled to the drum housing 158 and a second series 162 coupled to the fan shaft 44. The piston 116 drives the endplate 140 to apply pressure on the clutch plates 144, which engages the fan 16. The fan shaft 44 has multiple cooling passageways 164 that extend between a fan shaft chamber 166 and an inner drum chamber 168 allowing passage of fluid 48 therein. Fluid 48 after entering the drum chamber 168 passes across and directly cools the plates 144 and returns to the fluid reservoir 92 through slots 170 in the drum housing 158. The slots 170 may be of various size and shape and have various orientations relative to the center axis 130. The cooling passageways 164 although shown as extending perpendicular to the center axis 130 may extend parallel to the center axis 130, similar to the slots 170.

The return assembly 136 includes a set of return springs 172 and a spring retainer 174. The springs 172 reside in the fan shaft chamber 166 and are coupled between the fan shaft 44 and the spring retainer 174. The spring retainer 174 has a quarter cross-section that is "L" in shape and is coupled between the drive side 124 and the end plate 140. The springs 172 are in compression and exert force on the piston 116 so as to disengage the clutch plates 144 when fluid pressure on the pressure side 122 is below a predetermined level.

The control circuit 138 includes the distribution block 102, the fluid controller 29, and a main controller 28. The distribution block 102 may have various configurations depending upon the type and style of the fluid controller 29, only one is shown. The distribution block 102 contains a return channel 177 coupled to the controller branch 114. The fluid controller 29 may be coupled within a main center channel 178 of the block 102, adjust fluid flow through the return channel 177, may be coupled within the bracket 26, or be external to the block 102 and bracket 26. When the fluid controller 29 is coupled within the bracket 26 or external therefrom, tubes (not shown) may couple and extend from the controller branch 114 to the fluid controller 29 through the main center channel 178 and possibly through a center portion 180 of the bracket 26, when externally coupled. As shown, the fluid controller 29 adjusts fluid flow through the controller branch 114 across the main center channel 178, via the return channel 177, whereafter the fluid returns to the reservoir 92. In adjusting fluid flow through the controller branch 114, the fluid controller 29 adjusts pressure received by the piston 116. As the fluid controller 29 decreases fluid flow through the controller branch 114, pressure in the piston branch 112 and on the piston 116 increases.

The fluid controller 29 may adjust fluid pressure electronically, mechanically, or by a combination thereof. The fluid controller 29 although shown as an electronically controlled proportioning valve, may be of various type and style known in the art. The fluid controller 29 may be in the form of a solenoid, a bimetal coil device, a valve, or in some other form of fluid controller. The fluid controller 29 may have internal logic or reactive mechanisms to determine when to alter fluid flow or may be coupled to a separate controller, as shown, for such determination. The fluid controller 29 when not receiving a power signal or in a default mode, is preferably in a closed state to increase pressure on the piston 116 and engage the clutch plates 144. Therefore, when the engine 14 is in operation the fluid controller 29 defaults to a closed state to provide cooling even when the controller 29 is inoperative. By having a default state of closed, diagnostic testing of the system 12 is easily accomplished by simply preventing the fluid controller 29 from receiving the power signal, which may be accomplished by electrically unplugging the controller 29 or through use of a diagnostic tool or controller (not shown).

The main controller 28 is coupled to the fluid controller 29 and may be contained within the system 12 or may be separate from the system 12 as shown. The main controller 28 is preferably microprocessor based such as a computer having a central processing unit, memory (RAM and/or ROM), and associated input and output buses. The main controller 28 may be a portion of a central vehicle main control unit, an interactive vehicle dynamics module, a cooling system controller, or may be a stand-alone controller as shown. The main controller 28 generates a cooling signal containing information such as when cooling is desired and the amount of cooling that is desired. The fluid controller 29 in response to the cooling signal adjusts flow of the fluid 48 through the controller branch 114.

The main controller 28 may be used to derate or reduce rotational speed of the engine 14 and reduce traveling velocity of the vehicle 10. Even when cooling is not desired the main controller 28 may activate the fluid controller 29 to increase pressure on the piston 116 and engage the fan 16. Since at least a minimal amount of torque is utilized in operating the fan 16 the rotational speed of the engine 14 may thereby be reduced, everything else being the same.

The cooling circuit 42 includes a second pitot tube or lubrication tube 182. Although, only a single lubrication tube is shown, any number of lubrication tubes may be used, especially in applications where increased flow is desired. The lubrication tube 182 provides high flow rates at low pressures and as with the first tube may be of various size and shape. Fluid 48, from the cool side 150, enters the lubrication tube 182 and is directed into the fan shaft chamber 166 where it then passes through the cooling passageways 164 and cools the clutch pack 156. Fluid 48 may also exit the fan shaft chamber 166 through the slots 170. Fluid exiting from the fan shaft chamber 166 or the drum housing 158 enters the hot side 148, where the cooling fins 94 dissipate heat therefrom into the engine compartment 25. The cooling circuit 42 not only cools and lubricates the clutch pack 156 but also other portions of the engaging circuit 36.

Figure 3:
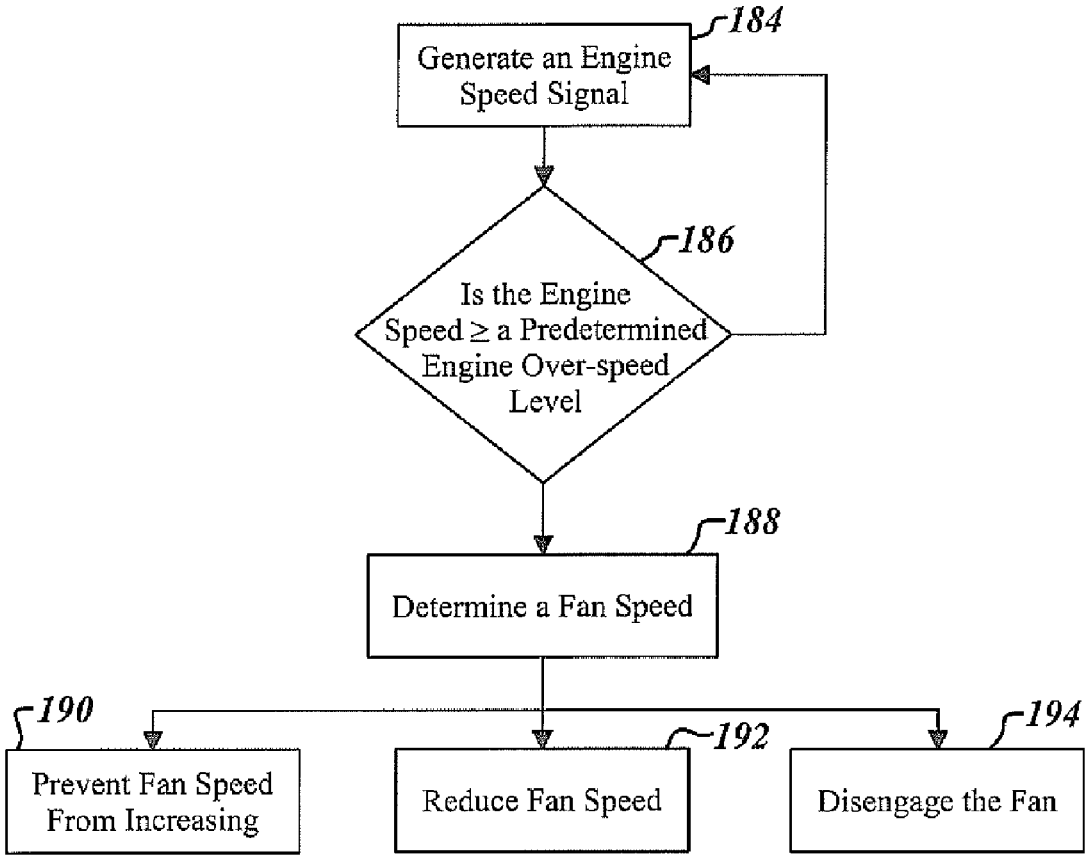
FIG. 3 is a logic flow diagram illustrating a method of controlling a fluid actuated fan drive system for an engine in accordance with an embodiment of the present invention.

Referring now to FIG. 3, a logic flow diagram illustrating a method of controlling a fluid actuated fan drive system for an engine in accordance with an embodiment of the present invention is shown.

In step 184, the sensor 31 generates an engine speed signal.

In step 186, a controller, such as the main controller 28, the fluid controller 29, or a combination thereof, limits the speed of the fan 16 when the engine speed is greater than or equal to a predetermined engine over-speed level. The controller compares the engine speed with the over-speed level. When the engine speed is greater than the over-speed level the controller limits or reduces the speed of the fan 16 and/or prevents the rotation of the fan 16.

In step 188, the controller may determine a current speed of the fan 16 in response to the engine speed. To determine the current fan speed the controller may multiply the engine speed by a fan speed to engine speed ratio, such as a pulley ratio correlating fan speed to engine speed.

In step 190, the controller limits the speed of the fan 16 or prevents the speed of the fan 16 from increasing beyond a current fan speed. In step 192, the controller reduces the current fan speed by the difference between the current fan speed and a predetermined fan maximum operating speed. In step 194, the controller disengages the fan 16.

In limiting or reducing the speed of the fan 16 or in preventing the fan 16 from rotating, the controller may limit or prevent pressure of fluid on the piston 116, limit fluid flow through the pitot tube 152, direct fluid flow through the return channel 177 to the reservoir 92, direct fluid flow from the pitot tube 152 to a reservoir 92, or limit fluid flow into a working chamber having clutch members, such as clutch members 144. The controller may as an alternative or in addition to that stated adjust the position of a valve or actuator. The controller may also alternatively or in addition thereto adjust a magnetic field applied on a magnetorheological fluid (not shown). Some viscous fan drive systems, as known in the art, operate or are engaged in response to the amount of magnetic field applied on a magnetorheological fluid. An example of a magnetorheological fluid drive system is described in U.S. Pat. No. 6,561,141, entitled "Water-cooled Magnetorheological Fluid Controlled Combination Fan Drive and Water Pump", which is incorporated herein by reference. Of course, there is an abundant of different techniques that may be utilized to limit or reduce the speed of the fan 16 and/or to disengage the fan 16, only some of which are mentioned above.

Figure 4:
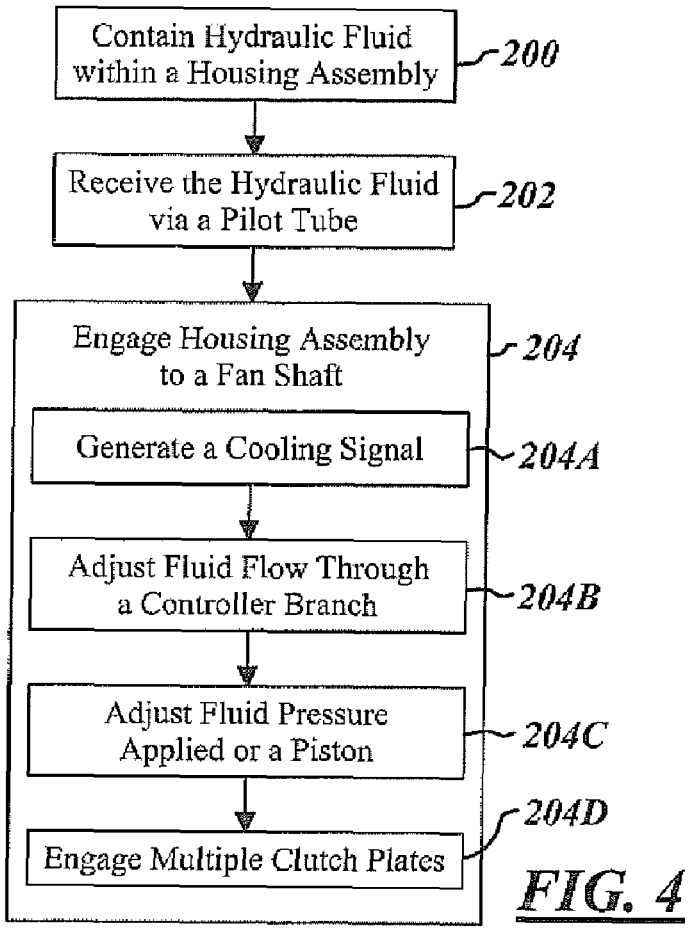
FIG. 4 is a logic flow diagram illustrating a method of engaging a fluid controlled fan drive system in accordance with an embodiment of the present invention.

Referring now to FIG. 4, a logic flow diagram illustrating a method of engaging the system 12 in accordance with an embodiment of the present invention is shown.

In step 200, the fluid 48 is contained within the housing assembly 20. In step 202, the pressure tube 152 receives at least a portion of the fluid 48.

In step 204, the housing assembly 20 is engaged to the fan shaft 44 to rotate the fan 16 in response to supply of the fluid 48 from the pressure tube 152. In step 204A, the main controller 28 generates the cooling signal to adjust fluid pressure on the piston 116. The main controller 28 may generate the cooling signal in response to operating temperature of the engine 14, to derate rotational speed of the engine 14, or to perform some other function known in the art. In step 204B, in response to the cooling signal the fluid controller 29 adjusts fluid flow through the controller branch 114.

In step 204C, fluid pressure on the piston 116 is adjusted in turn translating the piston 116 to force the endplate 140 to apply pressure on the clutch plates 144. The return springs 172 are overcome by fluid pressure applied in an opposing direction on the piston 116. The rotational speed of the housing assembly 20 in combination with the amount of fluid flow passing through the controller branch 114 and applied to the pressure side 122, which is directly related to the amount of pressure applied on piston 116.

In step 204D, the pressure applied on the piston 116 is directly transferred to the clutch plates 144. When pressure is applied on the clutch plates 144 the first series 160 is pressed against the second series 162, engaging the fan 16. Torque is generated on the clutch plates 144 and is approximately equal to the normal force of piston 116, multiplied by the number of plates 144, the coefficient of friction for wet friction hydrodynamic surfaces, such as surfaces of the clutch plates 144, and mean radius of plates 144. Therefore, rotational speed of the housing assembly 20 in combination with the amount of fluid flow passing through the controller branch 114 is also directly related to an amount of slip between the clutch plates 144 and the speed of the fan shaft 44.

Figure 5:
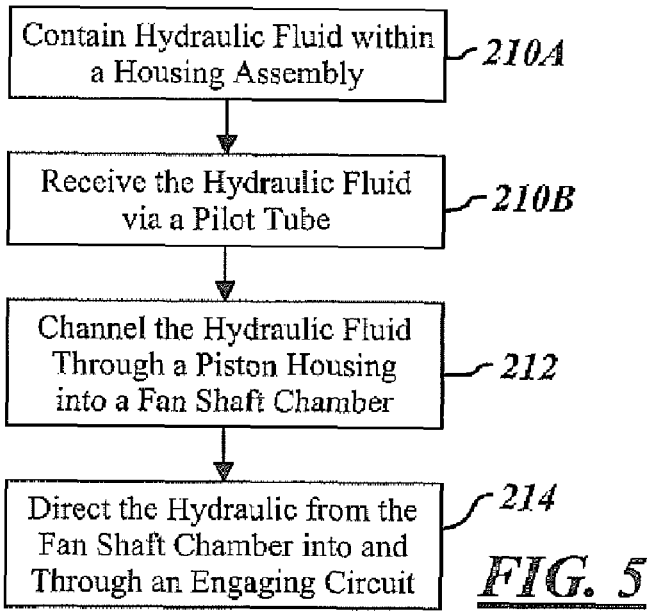
FIG. 5 is a logic flow diagram illustrating a method of cooling and lubricating an engaging circuit for the fluid controlled fan drive system in accordance with an embodiment of the present invention.

Referring now to FIG. 5, a method of cooling the engaging circuit 36 in accordance with an embodiment of the present invention is shown.

In step 210A-B, the lubrication tube 182 receives a portion of the fluid 48 contained within the reservoir 92 in a similar manner as that of the pressure tube 152.

In step 212, the fluid 48 is channeled through the piston housing 100 and into the fan shaft chamber 166 to cool the fan shaft 44 and return springs 172. This may become increasingly advantageous in times of repeated cycling of the system 12 between an engaged stated and a disengaged state.

In step 214, the fluid 48 is then passed from the fan shaft chamber 166 into the engaging circuit 36 where it is passed across and cools and lubricates the clutch plates 144 before reentering the reservoir 92. The fluid 48 also passes around and cools the spring retainer 174 and the piston 116.

The steps in the above-described methods are meant to be for illustrative example purposes only. The steps may be performed synchronously, sequentially, or in a different order depending upon the application.

Figure 6:
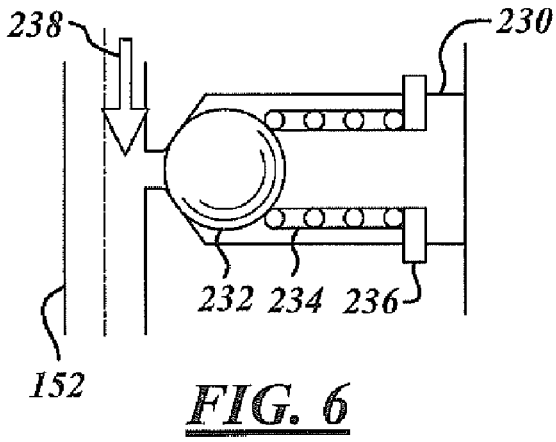
FIG. 6 is a cross-sectional view of a portion of the hydraulically controlled system utilizing a pressure relief valve in accordance with another embodiment of the present invention.

Referring now to FIG. 6 is a cross-sectional view of a portion of the hydraulically controlled system 12 utilizing a pressure relief valve 230 in accordance with another embodiment of the present invention is shown. The relief valve 230 is coupled to the pressure tube 152 and may include a ball 232, a spring 234, and a spring retainer 236. The arrow 238 represents direction of flow of the fluid 48. The relief valve 230 gradually opens when speed of the fan 16 is approximately greater than a predetermined speed. The spring 234 is designed to balance pressure exerted on the ball, pressure exceeding a pre-determined level is relieved to atmosphere or returned the fluid reservoir 92, thus limiting the maximum pressure in the pressure tube 152. The relief valve 230 may be set to open at any pressure corresponding to any fan speed. The relief valve 230 prevents damage to the system 12 at high fan speeds. The relief valve 230 may be mechanical or electrical in nature and may be of various form and style. The relief valve 230 may be coupled to the main controller 28 or to the fluid controller 29 and may be used to limit the speed of the fan 16 during an over-speed condition.

The present invention prevents damage to fan drive system components by preventing the fan from exceeding a predetermined maximum fan speed. The present invention monitors for an engine over-speed condition and in response thereto limits the speed of an engine-cooling fan.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. A method of controlling a fluid-actuated fan drive system for an engine, said method comprising the steps of:

(a) detecting an engine speed;

(b) calculating a current speed of a fluid-actuated engine-cooling fan by correlating said current speed to said engine speed as detected; and (c) limiting the speed of said fluid-actuated engine-cooling fan according to said current speed as calculated.

2. A method as in claim 1, wherein step (c) is at least partially accomplished by reducing said current speed by the difference between said current speed and a predetermined fan maximum operating speed when said current speed is determined to be greater than said predetermined fan maximum operating speed.

3. A method as in claim 1, wherein steps (b) and (c) are performed only when said engine speed is determined to be greater than or equal to a predetermined engine over-speed level.

4. A method as in claim 1, wherein step (b) is at least partially accomplished by multiplying said engine speed by a pulley ratio.

5. A method as in claim 1, wherein step (b) is at least partially accomplished by multiplying said engine speed by a fan speed to engine speed ratio.

6. A method as in claim 1, wherein step (c) is at least partially accomplished by limiting pressure of fluid on a piston.

7. A method as in claim 1, wherein step (c) is at least partially accomplished by limiting fluid flow through a pitot tube to a piston.

8. A method as in claim 1, wherein step (c) is at least partially accomplished by directing fluid flow through a return channel to a reservoir.

9. A method as in claim 1, wherein step (c) is at least partially accomplished by directing fluid flow from a pitot tube to a reservoir.

10. A method as in claim 1, wherein step (c) is at least partially accomplished by disengaging said fluid-actuated engine-cooling fan.

11. A method as in claim 1, wherein step (c) is at least partially accomplished by actuating a valve.

12. A method as in claim 1, wherein step (c) is at least partially accomplished by limiting fluid flow into a working chamber having clutch members.

13. A method as in claim 1, wherein step (c) is at least partially accomplished by adjusting a magnetic field applied on a magnetorheological fluid.

14. A method as in claim 1, wherein step (c) is at least partially accomplished by adjusting a position of an actuator.

15. A fluid-controlled fan drive system for an engine, said system comprising:

a sensor for detecting an engine speed of said engine and generating an engine speed signal that represents said engine speed;

a fluid-actuated engine-cooling fan;

an engagement circuit coupled to said fluid-actuated engine-cooling fan; and a controller coupled to both said sensor and said engagement circuit and operable to (i) calculate a current speed of said fluid-actuated engine-cooling fan by correlating said current speed to said engine speed as represented by said engine speed signal, and (ii) limit the operating speed of said fluid-actuated engine-cooling fan to less than a predetermined maximum level according to said current speed as calculated.

16. A fluid-controlled fan drive system as in claim 15, wherein said controller, in limiting said operating speed of said fluid-actuated engine-cooling fan, is operable to override an open-loop fan drive operation.

17. A fluid-controlled fan drive system as in claim 15, wherein said controller is operable to limit said operating speed of said fluid-actuated engine-cooling only when said engine speed signal is indicative of an engine over-speed condition.

18. A fluid-controlled fan drive system as in claim 15, wherein said controller, in determining calculating said current speed of said fluid-actuated engine-cooling fan, is operable to multiply said engine speed by a pulley ratio.

19. A method of controlling a fluid-actuated fan drive system for an engine, said method comprising the steps of:

(a) detecting an engine speed;

(b) calculating a current speed of a fluid-actuated engine-cooling fan by multiplying said engine speed by a fan speed to engine speed ratio; and (c) reducing said current speed by the difference between said current speed and a predetermined fan maximum operating speed when said current speed is determined to be greater than said predetermined fan maximum operating speed.

20. A method as in claim 19, wherein steps (b) and (c) are performed only when said engine speed is determined to be greater than or equal to a predetermined engine speed over-speed level.

* * * * *

UNITED STATES PATENT AND TRADEMARK OFFICE

CERTIFICATE OF CORRECTION

PATENT NO. : 7,415,945 B2
APPLICATION NO. : 10/908481
DATED : August 26, 2008
INVENTOR(S) : Michael D. Tuttle It is certified that error appears in the above-identified patent and that said Letters Patent is hereby corrected as shown below:

IN THE CLAIMS:

Column 10, Line 40, Claim 18: “in determining calculating” should read -- in calculating --

Column 10, Line 56, Claim 20: “engine speed over-speed level” should read -- engine over-speed level --

Signed and Sealed this
Twenty-first Day of February, 2012

David J. Kappos

David J. Kappos
*Director of the United States Patent and Trademark Office*